US007238909B2

(12) United States Patent
Beatty, Jr.

(10) Patent No.: US 7,238,909 B2
(45) Date of Patent: Jul. 3, 2007

(54) CIRCUIT BREAKER INCLUDING LINE CONDUCTOR HAVING BEND PORTION TO INCREASE CONTACT GAP

(75) Inventor: William E. Beatty, Jr., Beaver, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/254,529

(22) Filed: Oct. 19, 2005

(65) Prior Publication Data

US 2007/0084831 A1 Apr. 19, 2007

(51) Int. Cl.
*H01H 3/00* (2006.01)

(52) U.S. Cl. ..... 218/154; 218/153

(58) Field of Classification Search ..... 218/7, 218/14, 120, 140, 153, 154; 200/401, 244; 335/6–10, 15, 16, 18, 201, 202
See application file for complete search history.

(56) References Cited

U.S. PATENT DOCUMENTS 3,863,042 A 1/1975 Nicol
4,151,386 A 4/1979 Nicol et al.
4,645,890 A * 2/1987 Paton et al. ..... 200/401
5,264,673 A 11/1993 Powell
6,800,823 B1 * 10/2004 Malingowski et al. ..... 200/400
6,800,824 B1 * 10/2004 Slepian et al. ..... 200/400
6,853,274 B2 * 2/2005 Millburn et al. ..... 335/6
6,864,451 B1 3/2005 Slepian
6,870,115 B1 * 3/2005 Slepian ..... 200/401

* cited by examiner

*Primary Examiner*—Elvin Enad
*Assistant Examiner*—M. Fishman
(74) *Attorney, Agent, or Firm*—Martin J. Moran

(57) ABSTRACT

A circuit breaker includes line and load ends and separable contacts electrically disposed between the line and load ends. A movable arm carries a movable contact and includes an elongated body having a first general longitudinal axis and an offset disposed at one end. The offset displaces the movable contact relative to the first general longitudinal axis. A line conductor carries a fixed contact and is electrically connected between the line end and the movable contact. The line conductor includes a bend portion structured to increase a gap between the separable contacts in the open position. The bend portion forms an angle which is substantially greater than 90 degrees and less than 180 degrees between the fixed contact and the second general longitudinal axis, which is generally parallel to the first longitudinal axis in the closed position. An arc chute is disposed proximate the separable contacts.

3 Claims, 18 Drawing Sheets

CIRCUIT BREAKER INCLUDING LINE CONDUCTOR HAVING BEND PORTION TO INCREASE CONTACT GAP

CROSS-REFERENCE TO RELATED APPLICATIONS

This application is related to commonly assigned, concurrently filed:

U.S. patent application Ser. No. 11/254,300, filed Oct. 19, 2005, entitled "CIRCUIT BREAKER INTERMEDIATE LATCH";

U.S. patent application Ser. No. 11/254,298, filed Oct. 19, 2005, entitled "ELECTRICAL SWITCHING APPARATUS INCLUDING OPERATING MECHANISM HAVING INSULATING PORTION";

U.S. patent application Ser. No. 11/254,514, filed Oct. 19, 2005, entitled "AUXILIARY SWITCH INCLUDING MOVABLE SLIDER MEMBER AND ELECTRIC POWER APPARATUS EMPLOYING SAME";

U.S. patent application Ser. No. 11/254,299, filed Oct. 19, 2005, entitled "CONTACT ARM WITH 90 DEGREE OFFSET";

U.S. patent application Ser. No. 11/254,535, filed Oct. 19, 2005, entitled "CIRCUIT BREAKER COMMON TRIP LEVER";

U.S. patent application Ser. No. 11/254,509, filed Oct. 19, 2005, entitled "CIRCUIT BREAKER COMMON INTERPHASE LINK";

U.S. patent application Ser. No. 11/254,515, filed Oct. 19, 2005, entitled "CIRCUIT BREAKER INTERMEDIATE LATCH STOP";

U.S. patent application Ser. No. 11/254,513, filed Oct. 19, 2005, entitled "HANDLE ASSEMBLY HAVING AN INTEGRAL SLIDER THEREFOR AND ELECTRICAL SWITCHING APPARATUS EMPLOYING THE SAME".

BACKGROUND OF THE INVENTION

1. Field of the Invention

This invention pertains generally to electrical switching apparatus and, more particularly, to circuit breakers including a line conductor.

2. Background Information

Circuit breakers for telecommunication systems typically are smaller than circuit breakers associated with power distribution networks. A typical telecommunication system circuit breaker measures 2.5 inches high by 2.0 inches long by 0.75 inch thick, when the circuit breaker is viewed with the operating handle extending horizontally and moving in a vertical arc. While having a reduced size, the telecommunication system circuit breaker must still accommodate the various components and devices (e.g., separable contacts; trip device; operating mechanism) associated with larger circuit breakers. Thus, while the conventional components of a telecommunication system circuit breaker may not be unique, the necessity of having a reduced size requires specialized configurations and robust components that are different than power distribution circuit breakers. This is especially true where the telecommunication system circuit breakers are used in environments wherein the circuit breaker may be expected to operate for over 10,000 operating cycles and 50 tripping cycles; however, the reduced size telecommunication system circuit breakers are typically limited to a current rating of 30 amps.

The telecommunication system circuit breaker is structured to be disposed in a multi-level rack. The rack has multiple telecommunication system circuit breakers on each level. The rack, preferably, has a spacing between the levels of 1.75 inches; however, the current structure of telecommunication system circuit breakers, as noted above, have a height of 2.5 inches. As such, users have been required to adapt the multi-level rack to accommodate the taller telecommunication system circuit breakers.

Circuit breakers disposed on the rack may be coupled to associated circuits. As such, if the current is interrupted in a first circuit, either due to the circuit breaker tripping or due to a user manually interrupting the circuit, it is sometimes desirable to interrupt the current on an associated second circuit. In the prior art, a common trip bar was structured to trip two adjacent circuit breakers. That is, a single trip bar extended across two circuit breakers and, if an over current condition occurred in either circuit, the actuation of the trip device caused the trip bar to rotate thereby tripping both circuit breakers. In smaller circuit breakers which have a low trip force, the use of a common trip bar is not feasible.

Thus, while existing telecommunication system circuit breakers are small, there is still a need for telecommunication system circuit breakers having a reduced height, especially a telecommunication system circuit breaker having a height of about, or less than, 1.75 inches; the preferred spacing between levels on the rack. As the size of the telecommunication system circuit breakers are reduced further, the need for robust, yet small, components which operate in a reduced space is increased.

There remains the need for a circuit breaker, such as a telecommunication system circuit breaker, having a reduced size and an increased operating current range.

There is a further need for improved interruption capability in such a reduced size circuit breaker.

Accordingly, there is room for improvement in circuit breakers.

SUMMARY OF THE INVENTION

These needs and others are met by the present invention, which provides a circuit breaker including a line conductor having a bend portion structured to increase a gap between separable contacts in the open position of the circuit breaker. The bend portion forms an angle which is substantially greater than 90 degrees and less than 180 degrees between a fixed contact and a general longitudinal axis of the line conductor. A movable arm carries a movable contact and includes an elongated body having a general longitudinal axis and an offset disposed at one end. The offset displaces the movable contact relative to the general longitudinal axis of the line conductor, which is generally parallel to the general longitudinal axis of the movable arm in the closed position.

In accordance with one aspect of the invention, a circuit breaker comprises: a line end; a load end; a pair of separable contacts electrically disposed between the line end and the load end, the separable contacts including an open position and a closed position; an operating mechanism comprising a movable arm carrying one of the separable contacts, the movable arm comprising an elongated body having a first general longitudinal axis and an offset disposed at one end, the offset structured to displace the one of the separable contacts relative to the first general longitudinal axis of the elongated body, the operating mechanism structured to move the separable contacts between the open position and the closed position; a line conductor carrying the other one of the separable contacts, the line conductor electrically connected between the line end and the other one of the separable contacts, the line conductor including a second general longitudinal axis and a bend portion structured to increase a gap between the separable contacts in the open position, the bend portion forming an angle which is substantially greater than 90 degrees and less than 180 degrees between the other one of the separable contacts and the second general longitudinal axis, the first general longitudinal axis being generally parallel to the second general longitudinal axis in the closed position; and an arc chute disposed proximate the separable contacts.

The line conductor may include a first longitudinal segment and a second longitudinal segment, and the bend portion may be between the first longitudinal segment and the second longitudinal segment.

The bend portion may form an angle of about 170 degrees between the first longitudinal segment and the second general longitudinal axis which is parallel to the second longitudinal segment.

The bend portion may form an angle of between about 170 degrees and less than 180 degrees between the first longitudinal segment and the second general longitudinal axis which is parallel to the second longitudinal segment.

The bend portion may be a first bend portion, and the line conductor may further include two ninety-degree bend portions between the line end and the other one of the separable contacts. The line conductor may further include a first longitudinal segment and a second longitudinal segment. The first bend portion may be between the first longitudinal segment and the second longitudinal segment.

The first bend portion may form an angle of about 170 degrees between the first longitudinal segment and the second general longitudinal axis which is parallel to the second longitudinal segment.

The first bend portion may form an angle of between about 170 degrees and less than 180 degrees between the first longitudinal segment and the second general longitudinal axis which is parallel to the second longitudinal segment.

The offset may be an arcuate portion.

The circuit breaker may be a telecommunication system circuit breaker.

The offset may be further structured to dispose the one of the separable contacts at the angle of the bend portion in the closed position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, such as "vertical," "horizontal," "left," "right", "clockwise," etc. relate to the circuit breaker 10 as shown in most of the Figures, that is, with the handle assembly 400 located at the left side of the circuit breaker 10 (FIG. 5), and are not limiting upon the claims.

The present invention is disclosed in association with a telecommunication system circuit breaker 10, although the invention is applicable to a wide range of circuit breakers for a wide range of applications such as but not limited to residential or molded case circuit breakers.

Figure 5:
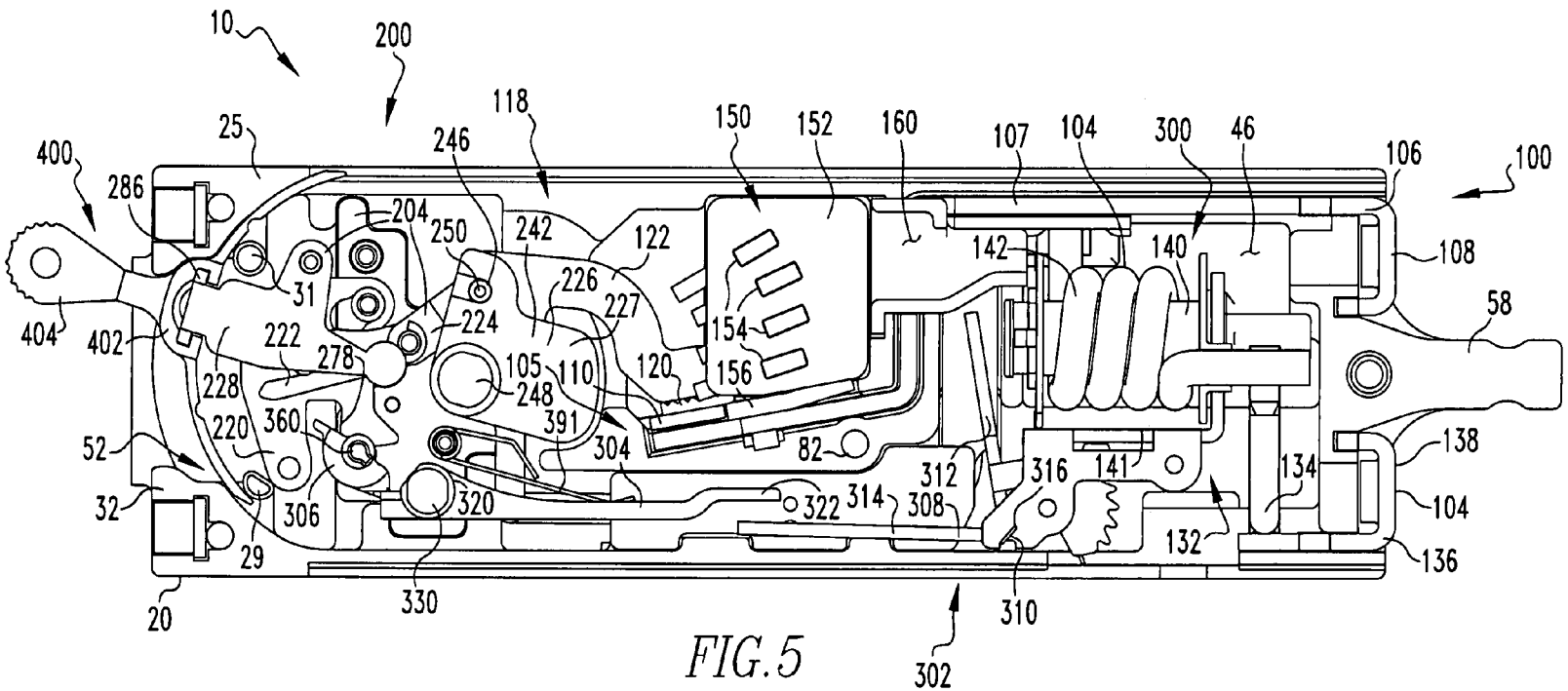
FIG. 5 is a side view of the circuit breaker of FIG. 1 with a housing half shell removed, the operating mechanism cage side plate removed, and showing the circuit breaker in the on position.
Figure 6:
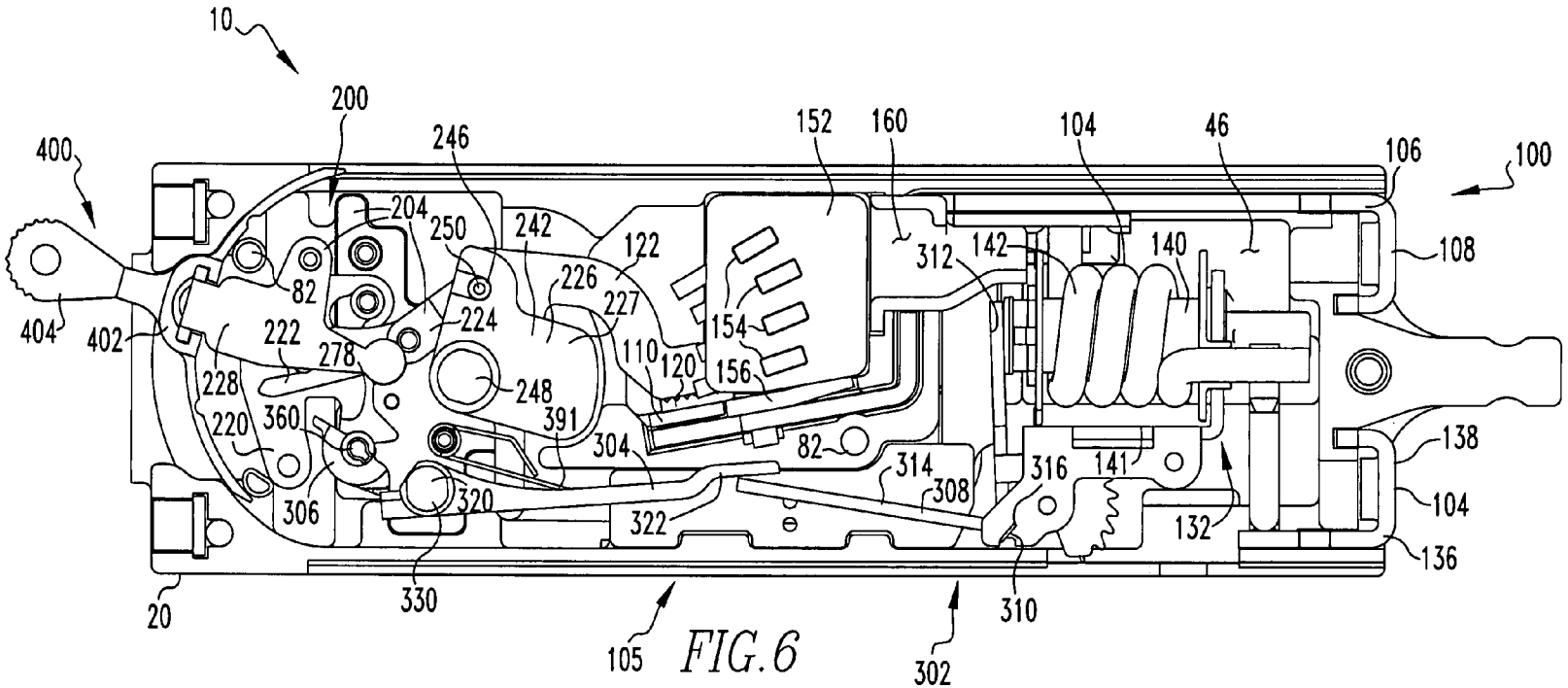
FIG. 6 is a side view of the circuit breaker of FIG. 1 with a housing half shell removed, the operating mechanism cage side plate removed, and showing the circuit breaker just after an over current condition occurs.

As shown in FIGS. 1–4, a circuit breaker 10 includes a housing assembly 20, a current path assembly 100 (FIG. 3), an operating mechanism 200, a trip device 300, and a handle assembly 400. Generally, the current path assembly 100 includes a pair of separable contacts 105 (FIG. 3) including a first, fixed contact 110 and a second, movable contact 120. The movable contact 120 is structured to be moved by the operating mechanism 200 between a first, closed position, wherein the contacts 110, 120 are in electrical communication, and a second, open position (FIG. 7), wherein the contacts 110, 120 are separated, thereby preventing electrical communication therebetween. As shown in FIGS. 5–9, the operating mechanism 200 is structured to move between four configurations or positions: a closed position, which is the normal operating position (FIG. 5), a tripped position (FIG. 7), which occurs after an over-current condition, an open position (FIG. 8), which occurs after a user manually actuates and opens the circuit breaker 10, and a reset position (FIG. 9), which repositions certain elements, described below, so that the contacts 110, 120 may be closed. FIG. 6 shows the operating mechanism 200 in a transitional position, just as an over current condition occurs. When the operating mechanism 200 is in the closed position, the contacts 110, 120 are also in the closed position. When the operating mechanism 200 is in the tripped position, the open position, or the reset position, the contacts 110, 120 are in the open position.

The trip device 300 interacts with both the current path assembly 100 and the operating mechanism 200. The trip device 300 is structured to detect an over current condition in the current path assembly 100 and to actuate the operating mechanism 200 to move the contacts 110, 120 from the first, closed position to the second, open position. The handle assembly 400 includes a handle member 404 (described below), which protrudes from the housing assembly 20. The handle assembly 400 further interfaces with the operating mechanism 200 and allows a user to manually actuate the operating mechanism 200 and move the operating mechanism 200 between an on position, an off position, and a reset position.

Figure 1:
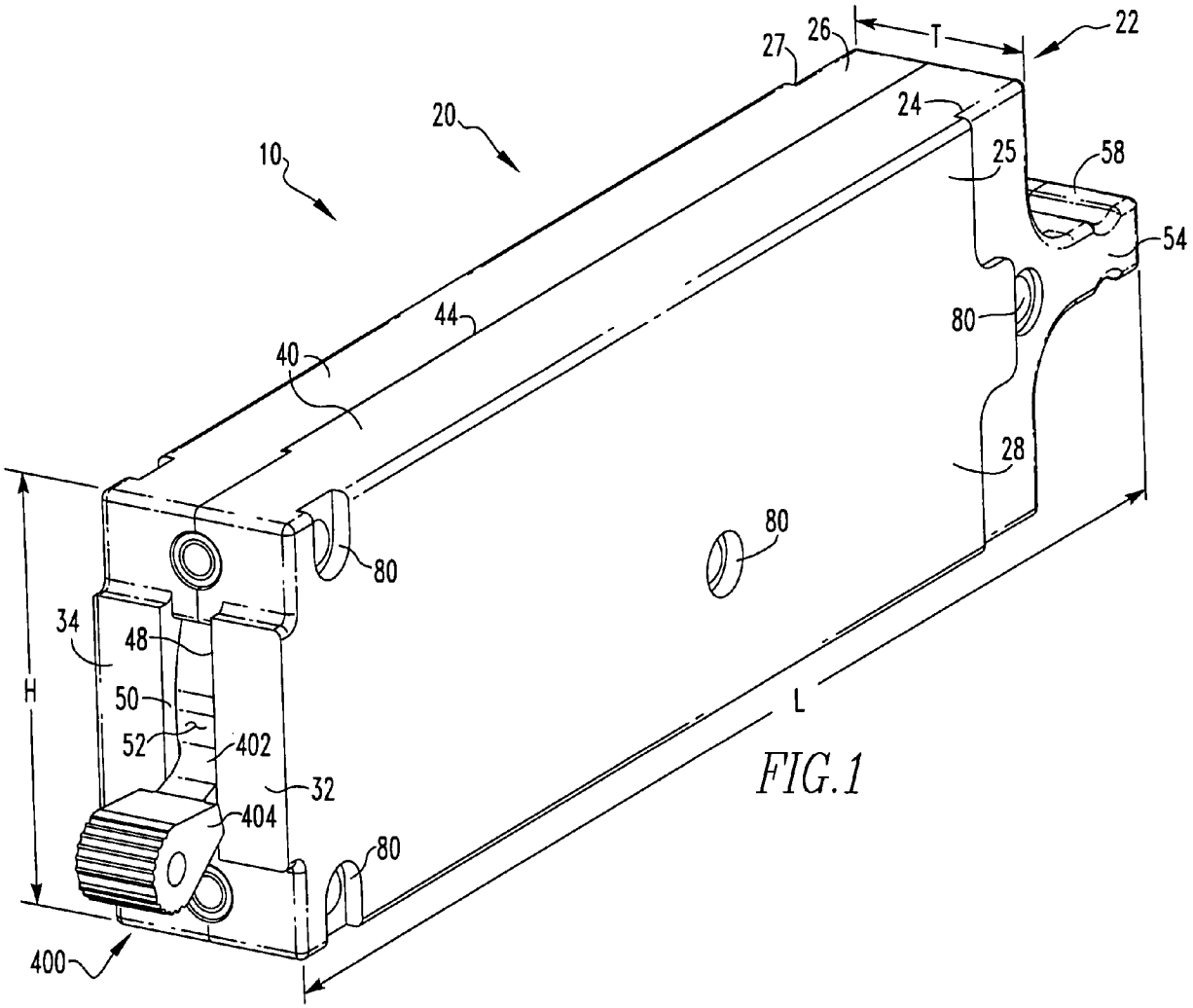
FIG. 1 is an isometric view of a circuit breaker in accordance with the present invention showing the left side.
Figure 2:
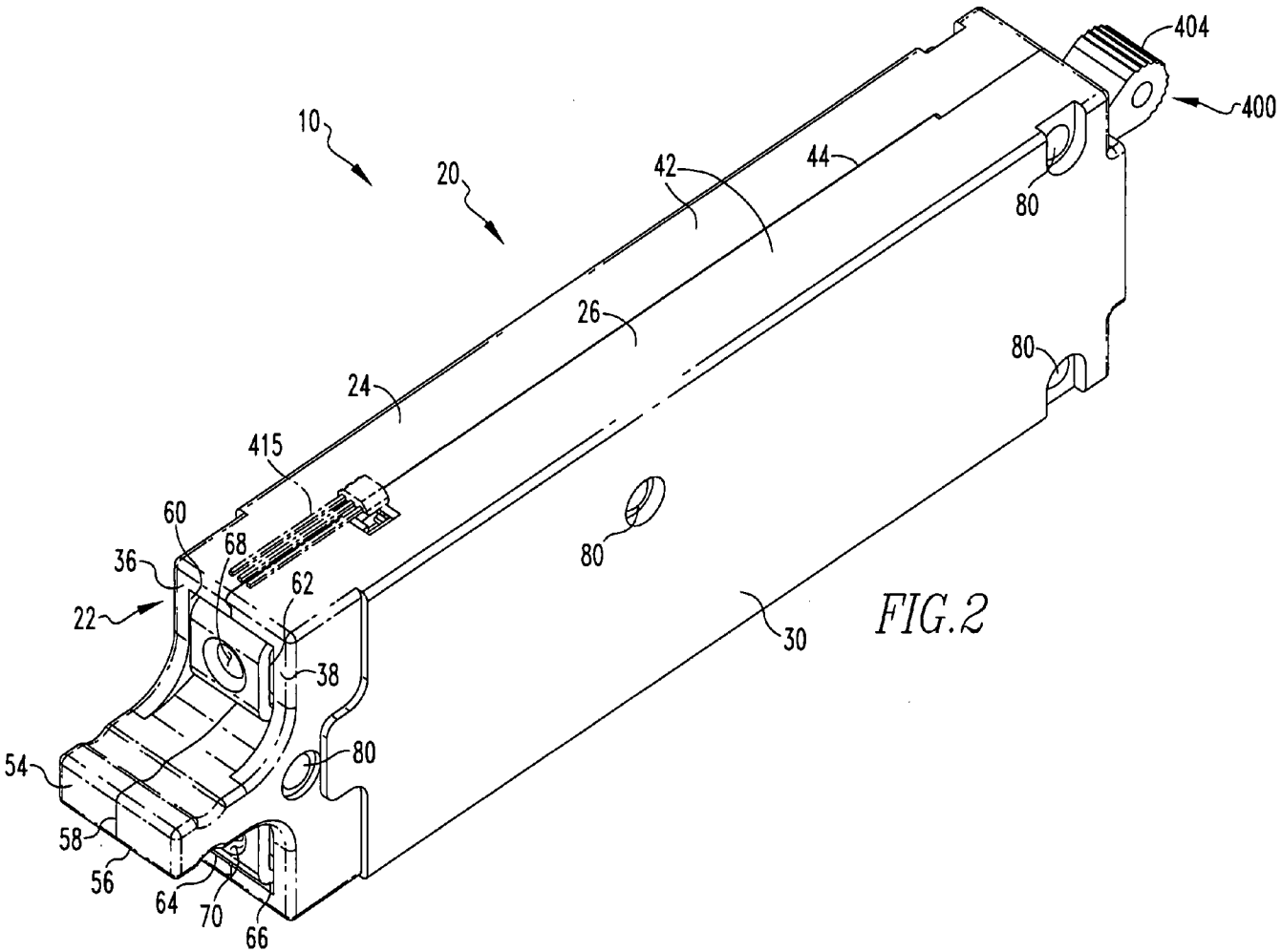
FIG. 2 is an isometric view of the circuit breaker of FIG. 1 showing the right side.

As shown in FIGS. 1 and 2, the housing assembly 20 is, generally, made from a non-conductive material. The housing assembly 20 includes a base assembly 22 having a first base member 24 and a second base member 26, a first side plate 28 and a second side plate 30. The housing assembly first side plate 28 may be formed integrally, that is, as one piece, with the housing assembly first base member 24. Similarly, the housing assembly second side plate 30 may be formed integrally with the housing assembly second base member 26. When a housing assembly base member 24, 26 is formed integrally with a housing assembly side plate 28, 30, the combined element may be identified as a housing assembly half shell 25, 27. The housing assembly half shells 25, 27 each have a generally elongated rectangular shape with a top side 32, 34 and a bottom side 36, 38 as well as lateral sides 40, 42. The housing assembly half shells 25, 27 are structured to be coupled together along a generally flat interface 44 thereby forming a substantially enclosed space 46 (FIG. 5). Each half shell top side 32, 34 includes a handle recess 48, 50 along the interface 44. When the two half shells 25, 27 are coupled together, the two recesses 48, 50 form a handle member opening 52. The half shell bottom sides 36, 38 (FIG. 2) each include a central extension 54, 56 disposed generally along the longitudinal axis of the housing assembly 20. The two extensions 54, 56 form a mounting foot 58 structured to engage an optional snap on barrier structured to maintain the spacing between the line and load terminals (not shown). The half shell bottom sides 36, 38 further each include two conductor recesses 60, 62, 64, 66 along the interface 44. When the two half shells 25, 27 are coupled together, the conductor recesses 60, 62, 64, 66 form two conductor openings 68, 70.

The housing assembly 20, preferably, has a length, represented by the letter "L" in FIG. 1, between about 5.0 and 4.0 inches, and more preferably about 4.6 inches. The housing assembly 20 also has a height, represented by the letter "H" in FIG. 1, of, preferably, between about 1.75 inches and 1.0 inch, and more preferably about 1.5 inches. Further, housing assembly 20, preferably, has a thickness, represented by the letter "T" in FIG. 1, of between about 1.0 inch and 0.5 inch, and more preferably about 0.75 inch. The two half shells 25, 27 are, preferably, held together by a plurality of rivets (not shown). The two half shells 25, 27 also include a plurality of fastener openings 80.

Within the enclosed space 46 (FIG. 5), each fastener opening 80 may be surrounded by a tubular collar 82. Fasteners, such as, but not limited to, nuts and bolts (not shown), extend through the openings 80 and collars 82 and may be used to couple the two half shells 25, 27 together. The internal components are held in place by the coupling of the half shells 25, 27. The collars 82, preferably, have an extended length so that the fasteners within the fastener openings 80 are substantially separated from the enclosed space 46. As is known in the art, the half shells 25, 27 may have support posts 29, 31 (FIG. 3), pivot pin openings, pockets, and other support structures molded thereon and are structured to support or mount the various other components, such as the operating mechanism 200, within the housing assembly 20. Accordingly, as used herein, when a component is said to be coupled to the housing assembly 20, it is understood that the housing assembly 20 includes an appropriate support post, pivot pin opening, pocket, or other support structure(s) needed to engage the component.

Figure 3:
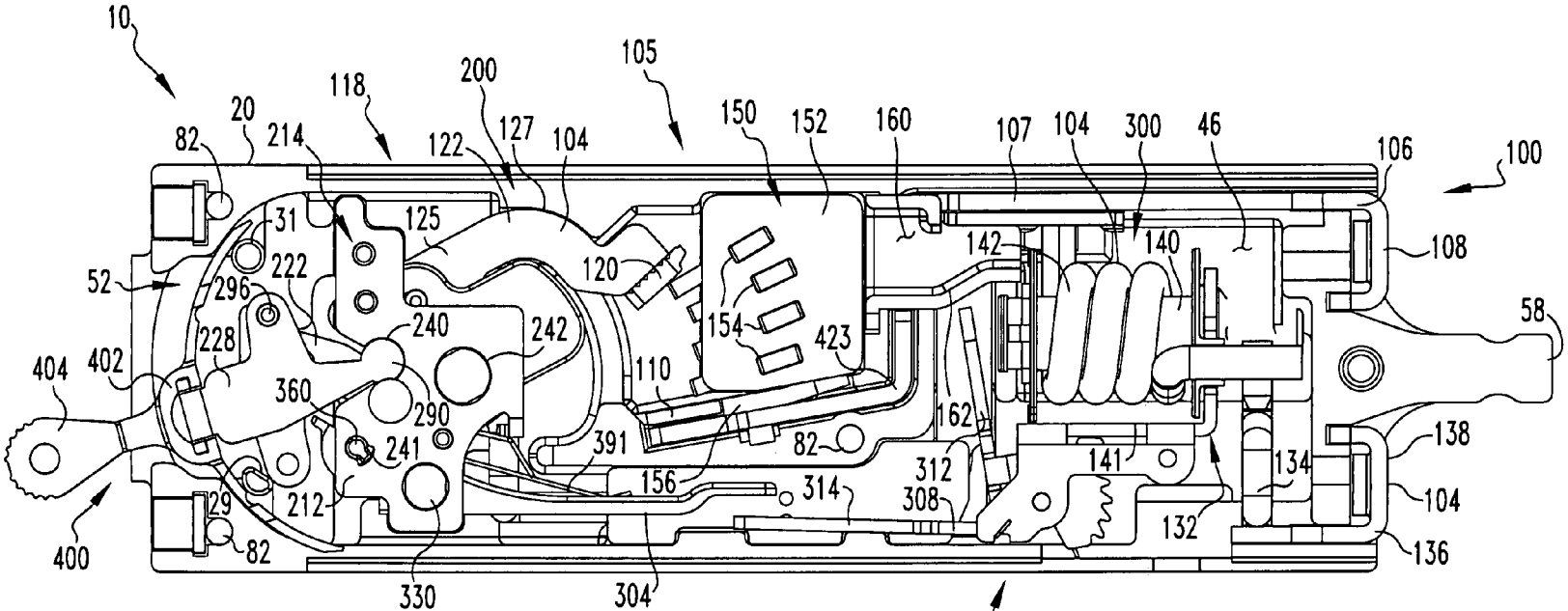
FIG. 3 is a side view of the circuit breaker of FIG. 1 with a housing half shell removed.
Figure 4:
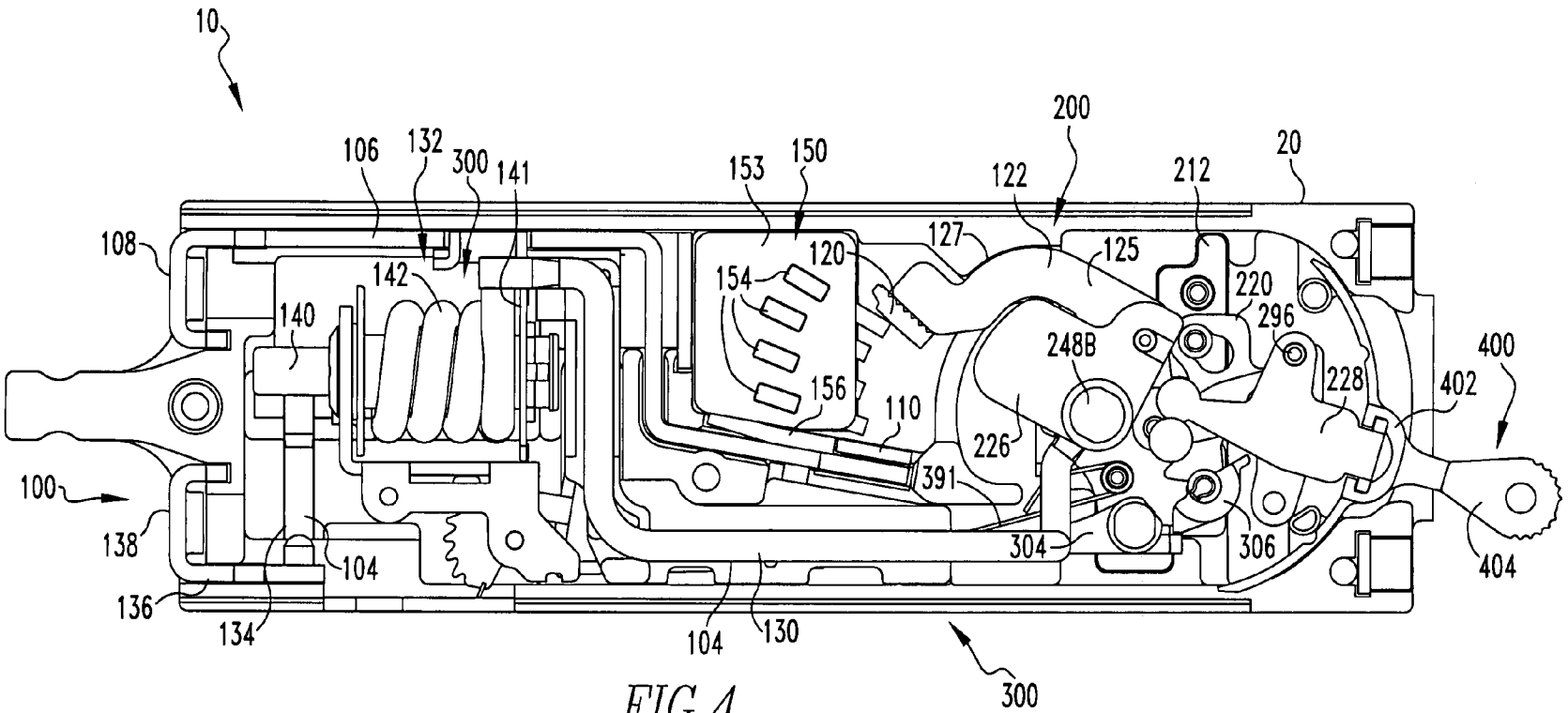
FIG. 4 is a back side view of the circuit breaker of FIG. 1 with a housing half shell removed.
Figure 12:
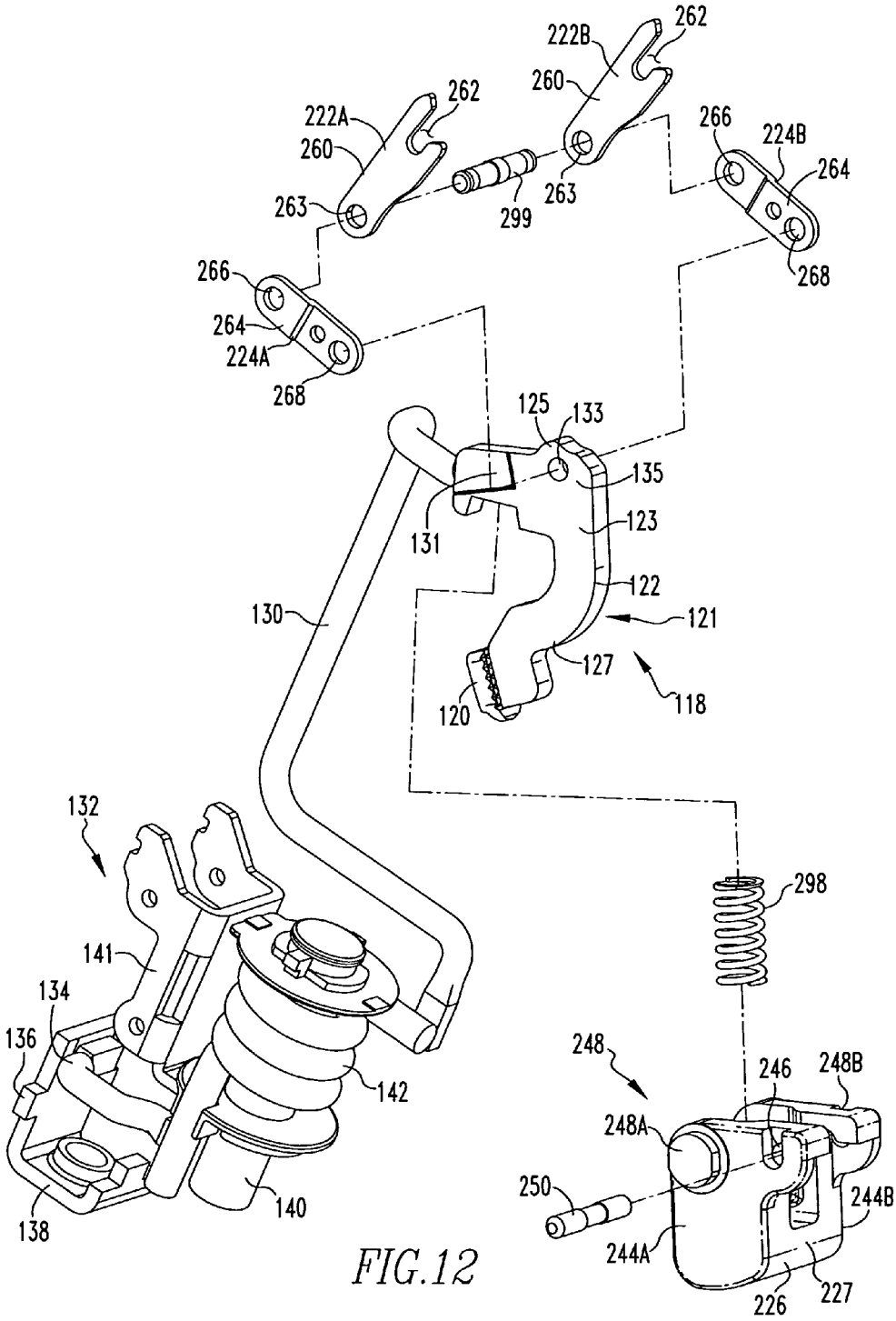
FIG. 12 is an exploded detail view of a portion of the operating mechanism and a portion of the conductor assembly for the circuit breaker of FIG. 1.

As shown in FIGS. 3–4 and 12 the current path assembly 100 is disposed substantially within the housing assembly 20 and includes a plurality of conductive members 104 which are, but for the contacts 110, 120 while in the open position, in electrical communication. As such, current may flow through the circuit breaker 10 so long as the contacts 110,120 are closed. Following a path from the line side of the circuit breaker 10 to the load side of the circuit breaker 10, the conductive members 104 include an elongated line conductor assembly 106 having a line conductor body 107, a line conductor end portion 108 and the fixed contact 110, a movable contact assembly 118 having the movable contact 120 coupled to a moving arm 122, a first shunt 130 (FIG. 4) which is a flexible conductive member such as, but not limited to, a braided wire, a coil assembly 132, a second shunt 134, and a load conductor 136 having a load conductor end portion 138.

Figure 13:
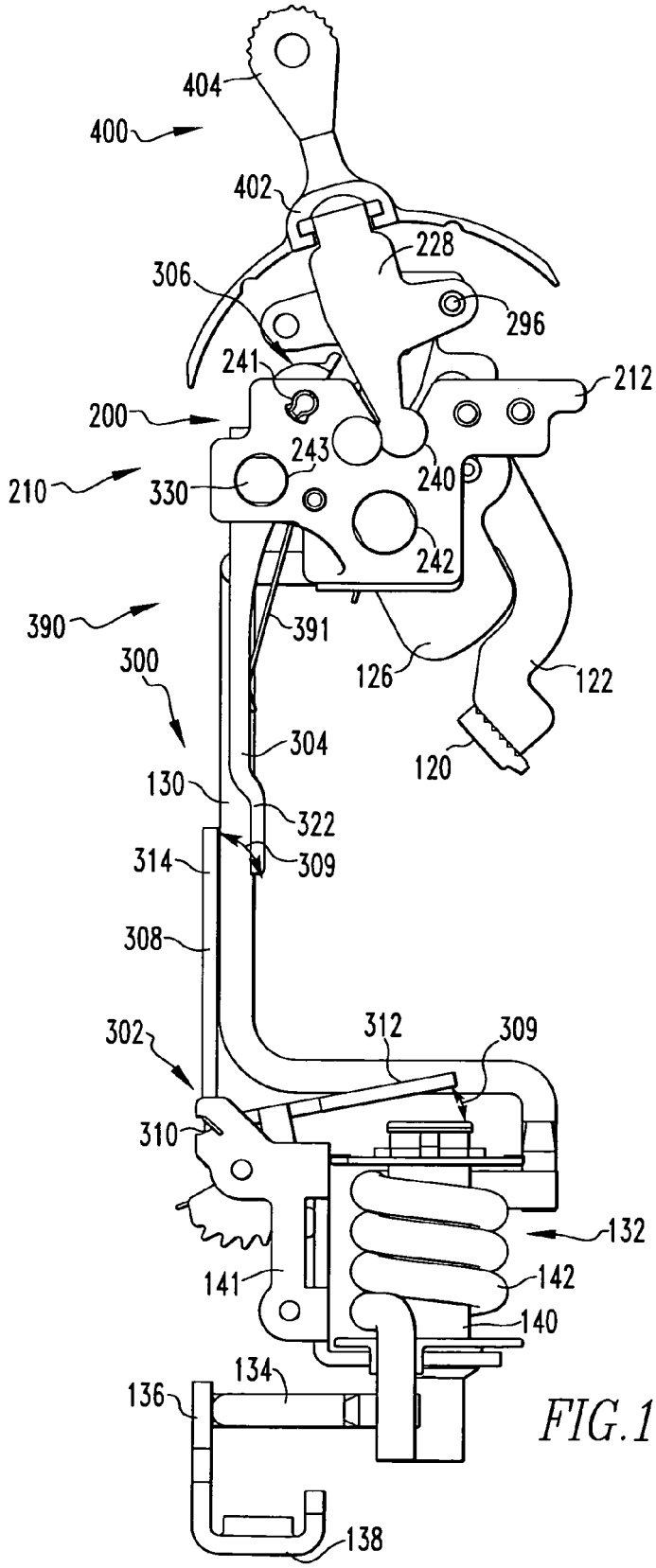
FIG. 13 is a detailed side view of the trip device of FIG. 5 in the tripped position.

As seen in FIG. 12, the moving arm 122 includes an elongated body 123 having a mounting extension 125 located at one end and an offset 121, preferably an arcuate portion 127, disposed at the opposite end. The offset 121 is structured to displace the movable contact 120 relative to the longitudinal axis of the moving arm body 123. The arcuate portion 127, preferably, extends between about 80 to 110 degrees, and more preferably about 90 degrees. The movable contact 120 is disposed at the distal end of the arcuate portion 127. The mounting extension 125 includes a mounting end 131, a central pivot opening 133, and a stop pin end 135. The coil assembly 132 includes a spool 140, a coil assembly frame 141 supporting the spool 140, and a coiled conductor 142 wrapped around the spool 140. As current is passed through the coiled conductor 142 a magnetic field is created as is known in the art. The greater the current passing through the coil assembly 132, the stronger the magnetic field. The coil assembly 132 is sized so that the magnetic field created during an over current condition is sufficient to move the armature assembly armature 308 (FIG. 13). As such, the coil assembly 132 is also an integral part of the trip device 300 (FIG. 5) and may also be described as a part of the trip device 300. The current path assembly 100 further includes an arc extinguisher assembly 150 that is disposed about the fixed contact 110 and the movable contact 120.

The arc extinguisher assembly 150 includes arc extinguisher side plates 152, 153 within which are positioned spaced-apart generally parallel angularly offset arc chute plates 154 and an arc runner 156. As is known in the art, the function of the arc extinguisher assembly 150 is to receive and dissipate electrical arcs that are created upon separation of the contacts 110, 120 as the contacts 110, 120 are moved from the closed to the open position. The arc extinguisher assembly 150 also includes a gas channel 160 (FIG. 3). The gas channel 160 may be created by a plurality of molded walls extending from any of the two half shells 25, 27, or, preferably, is a separate molded piece 162 structured to be coupled to the two half shells 25, 27. The gas channel 160 is disposed on the side of the arc extinguisher assembly 150 opposite the contacts 110, 120 and is structured to direct arc gases to one or more openings (not shown) in the housing assembly 20.

When installed in the housing assembly 20, the line conductor end portion 108 and the load conductor end portion 138 each extend through one of the conductor openings 68, 70 (FIG. 2). In this configuration, the line conductor end portion 108 and the load conductor end portion 138 may each be coupled to, and in electrical communication with, a power distribution network (not shown). Both the line conductor assembly 106 and the load conductor 136 extend into the enclosed space 46 (FIG. 5). The line conductor assembly 106 is coupled to the housing assembly 20 so that the fixed contact 110 remains substantially stationary. The moving arm 122 is movably coupled to the operating mechanism 200 so that the movable contact 120 may be positioned in contact with the fixed contact 110 (FIG. 5). When the contacts 110, 120 are in the first, closed position, current may flow between the fixed contact 110 and the movable contact 120. The movable contact 120 is further coupled to, and in electrical communication with, one end of the first shunt 130 (FIG. 12). The first shunt 130 extends through the enclosed space 46 so that another end of the first shunt 130 may be, and is, coupled to, and in electrical communication with, the coil assembly 132. The coil assembly 132 is further coupled to, and in electrical communication with, the second shunt 134. The second shunt 134 is also coupled to, and in electrical communication with, the load conductor 136. As such, when the contacts 110, 120 are in the first, closed position, the current path assembly 100 provides a path for current through the circuit breaker 10 including passing through the coil assembly 132 which generates a magnetic field. When in the second position, the contacts 110, 120 are separated by a distance of between about 0.400 and 0.550 inch, and more preferably by about 0.550 inch.

As shown best in FIGS. 5–12, the operating mechanism 200 includes a plurality of rigid members 204 structured to be movable between four configurations or positions: a closed position (FIG. 5), which is the normal operating position; a tripped position (FIG. 7), which occurs after an over-current condition; an open position (FIG. 8), which occurs after a user manually actuates the circuit breaker 10; and a reset position (FIG. 9), which repositions certain members 204, described below, so that the contacts 110, 120 may be closed. In the preferred embodiment, the rigid members 204 are disposed in a generally layered/mirrored configuration. That is, whereas certain members 204 in the central layer are singular elements, other members 204 in the outer layers include two separate elements disposed on either side of the central elements. As set forth below, each member 204 will have a single reference number, however, when necessary to describe a member 204 that is split into two elements, that member's 204 reference number will be followed by either the letter "A" or the letter "B," wherein each letter differentiates between the two separate elements. For example, the operating mechanism 200 includes, preferably, two first links 222A, 222B (FIG. 12). However, when shown in the Figures as a side view, FIG. 10, only a single first link 222 is visible and is identified. The same is true for elements such as, but not limited to, the primary spring 232 and the second link 224 (described below). Similarly, another member 204, such as handle arm 228 (described below) may be said to be coupled to the side plate 212 (described below) and it is understood that, unless otherwise specified, the handle arm 228 is coupled to both side plates 212A, 212B located on either side of the cage 210 (FIG. 3).

The operating mechanism 200 includes the cage 210 (FIG. 3), that is structured to be coupled to the housing assembly 20, a cradle 220 (FIG. 5), the first link 222, the second link 224, a moving arm carrier 226, and a handle arm 228. The operating mechanism 200 also includes a plurality of springs 230 including at least one primary spring 232. The operating mechanism side plate 212 includes a body 213 having a plurality of openings 214. The openings 214 on the side plate 212 include a handle arm opening 240 (FIG. 3) and a moving arm carrier opening 242 (FIG. 3). As seen best in FIG. 12, the moving arm carrier 226 includes a molded body 227 having two lateral side plates 244A, 244B each having an opening 246. A moving arm pivot pin 250 is disposed within the moving arm side plate openings 246 and extends between the moving arm carrier side plates 244A, 244B. The moving arm carrier molded body 227, preferably, acts to direct arc gases away from other circuit breaker 10 components. The moving arm carrier 226 also includes a pivot disk 248 that extends outwardly from each side plate 244A, 244B toward the adjacent housing assembly side plate 28, 30. The first link 222 has a generally elongated body 260 having first and second pivot pin openings 262, 263 at opposing ends. The second link 224 also has a generally elongated body 264 having first and second pivot pin openings 266, 267 at opposing ends. As seen best in FIG. 11, the cradle 220 has a generally planar body 270 having an elongated base portion 272 with a generally perpendicular extension 274. The base portion 272 includes, adjacent to one end, a pivot pin opening 276 and, on the end opposite the pivot pin opening 276, a latch edge 278. The extension 274 has an arced bearing surface 280. The base portion 272 also includes a pivot pin opening 279 and a pivot pin 281 extending therethrough so that the pivot pin 281 extends on each side of the cradle planar body 270, generally perpendicular to the plane of the cradle planar body 270. The pivot pin 281 acts as a pivot for the first links 222A, 222B, as described below. The extension 274 may have an inter-phase link extension 275 having an inter-phase link opening 277. The inter-phase link extension 275 extends toward the latch edge 278 and has a sufficient length to extend beyond the handle arm 228 when the operating mechanism 200 is assembled, as described below.

The handle arm 228 has an inverted, generally U-shaped body 282 with two elongated side plates 284A, 284B and a generally perpendicular bight member 286 extending between the handle arm side plates 284A, 284B. The bight member 286 includes at least one, and preferably two, spring mountings 288A, 288B. Each handle arm side plate 284A, 284B includes a generally circular distal end 290 structured to engage the cage 210 and act as a pivot. Each handle arm side plate 284A, 284B further includes an extension 292 having an opening 294. The handle arm side plate extension 292A, 292B extends generally perpendicular to the longitudinal axis of the associated handle arm side plate 284A, 284B while being in generally the same plane as the side plate 284A, 284B. A cradle reset pin 296 extends between the two handle arm side plate extension openings 294A, 294B.

Figure 11:
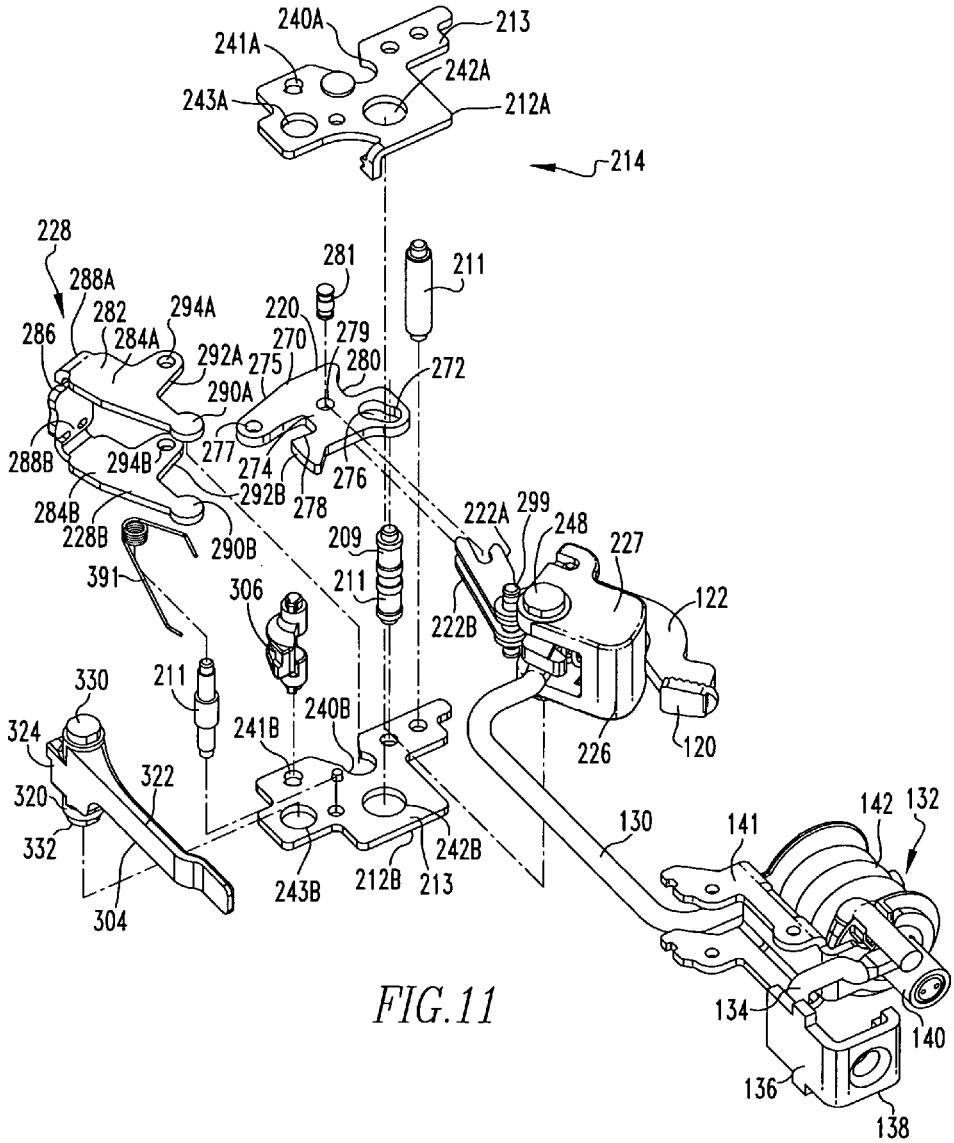
FIG. 11 is a partially exploded view of the operating mechanism of FIG. 10.

The operating mechanism 200 is assembled as follows. The cage 210 (FIG. 3) is coupled to the housing assembly 20, preferably near the handle member opening 52. The handle arm 228 is pivotally coupled to the cage 210 with one handle arm side plate circular distal end 290A, 290B disposed in each cage side plate handle arm opening 240A, 240B. Similarly, the moving arm carrier 226 is pivotally coupled to the cage 210 with one pivot disk 248A, 248B disposed in each moving arm carrier opening 242A, 242B. As noted above, the moving arm pivot pin 250 is disposed within the moving arm carrier openings 242A, 242B and extends between the moving arm carrier side plates 244A, 244B. The moving arm 122 is coupled to the moving arm pivot pin 250 with the moving arm pivot pin 250 extending through the mounting extension central pivot opening 133. The moving arm mounting end 131 extends into the moving arm carrier 226. A moving arm spring 298 may be disposed in the moving arm carrier 226. The moving arm spring 298 is a compression spring contacting the moving arm carrier 226 and biasing the moving arm 122 about the moving arm pivot pin 250 so that the moving arm elongated body 123 contacts the moving arm carrier 226. That is, as shown in FIG. 11, the moving arm spring 298 biases the moving arm mounting end 131 in an upward direction, as shown in FIG. 12, which, in turn, creates a torque about the moving arm pivot pin 250 causing the moving arm elongated body 123 to be biased against the moving arm carrier 226.

The second link 224 is also pivotally coupled to the moving arm pivot pin 250 and extends, generally, toward the handle arm 228. More specifically, the moving arm pivot pin 250 extends through the second link pivot pin opening 264. The second link 224 is also pivotally coupled to the first link 222. More specifically, a link pivot pin 299 extends through the first link second pivot pin opening 263 and the second link first pivot pin opening 266. The first link first pivot pin opening 262, which may be a generally U-shaped slot, is coupled to a cradle body pivot pin 281. The primary spring 232, a tension spring, extends from the handle arm bight member spring mounting 288 to the link pivot pin 299.

In this configuration, the primary spring 232 generally biases the second link 224 and the cradle 220 generally toward the handle member 404, which in turn, biases the moving arm 122 and movable contact 120 to the second, open position. During normal operation with current passing through the circuit breaker 10, the trip device 300 holds the operating mechanism 200 in the closed position. As set forth above, when the operating mechanism 200 is in the closed position, the contacts 110, 120 are in electrical communication. More specifically, during normal operation, the cradle latch edge 278 is engaged by the trip device 300 thereby preventing the bias of the primary spring 232 from moving the operating mechanism 200 into the tripped position. When an over-current condition occurs, the trip device 300 disengages from the cradle latch edge 278 thereby allowing the bias of the primary spring 232 to move the operating mechanism 200 into a tripped position. With the operating mechanism 200 in the tripped position, the contacts 110, 120 are separated.

To return the circuit breaker 10 to the normal operating configuration, a user must move the operating mechanism 200 into the reset position wherein the cradle body latch edge 278 re-engages the trip device 300. That is, when the operating mechanism 200 is in the tripped position, the reset pin 296 is disposed adjacent to the arced bearing surface 280 on the cradle 220. When a user moves the handle assembly 400 (described below and coupled to the handle arm 228) to the reset position, the reset pin 296 engages the arced bearing surface 280 on the cradle 220 and moves the cradle 220 to the reset position as well. In the reset position, the cradle body latch edge 278 moves below, as shown in the figures, the intermediate latch operating mechanism latch 345 (described below) thereby re-engaging the trip device 300. Once the cradle body latch edge 278 re-engages the trip device 300, the user may move the operating mechanism 200 back to the closed position wherein the contacts 110, 120 are closed. Again, because the trip device 300 in engaged, the bias of the primary spring 232 is resisted and the operating mechanism 200 is maintained in the on position.

Additionally, the user may manually move the operating mechanism 200 to an open position which causes the contacts 110, 120 to be separated without disengaging the trip device 300. When a user moves the handle assembly 400 (described below and coupled to the handle arm 228) to the off position, the direction of the bias primary spring 232, that is the direction of the force created by the primary spring 232, changes so that the second link 224 moves independently of the cradle 220. Thus, the bias of the primary spring 232 causes the moving arm 122 to move away from the fixed contact 110 until the contacts 110, 120 are in the second, open position. As noted above, when the operating mechanism 200 is in the off position, the trip device 300 still engages the cradle 220. Thus, to close the contacts 110, 120 from the off position, a user simply moves the handle assembly 400 back to the on position without having to move to the reset position. As the user moves the handle assembly 400 to the on position, the direction of the bias primary spring 232 causes the second link 224 to move away from the handle member 404 thereby moving the moving arm 122 toward the fixed contact 110 and returning the contacts 110, 120 to the first, closed position.

Figure 14:
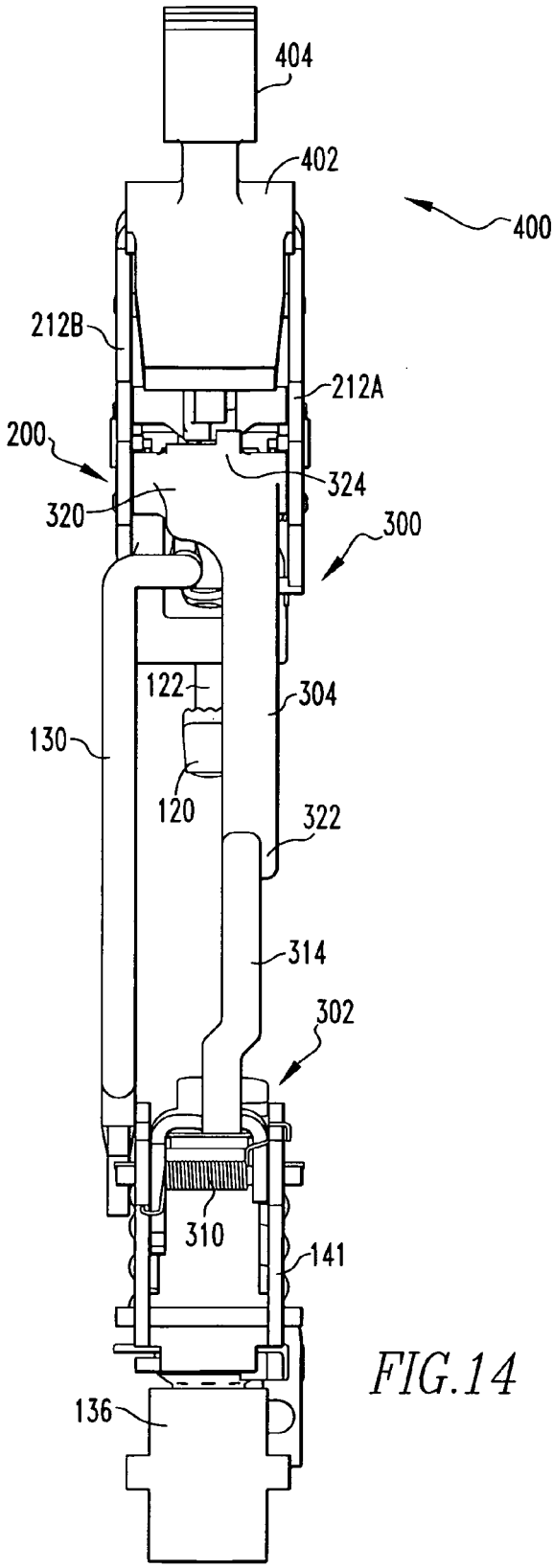
FIG. 14 is a detailed end view of the trip device of FIG. 5 in the tripped position.
Figure 15:
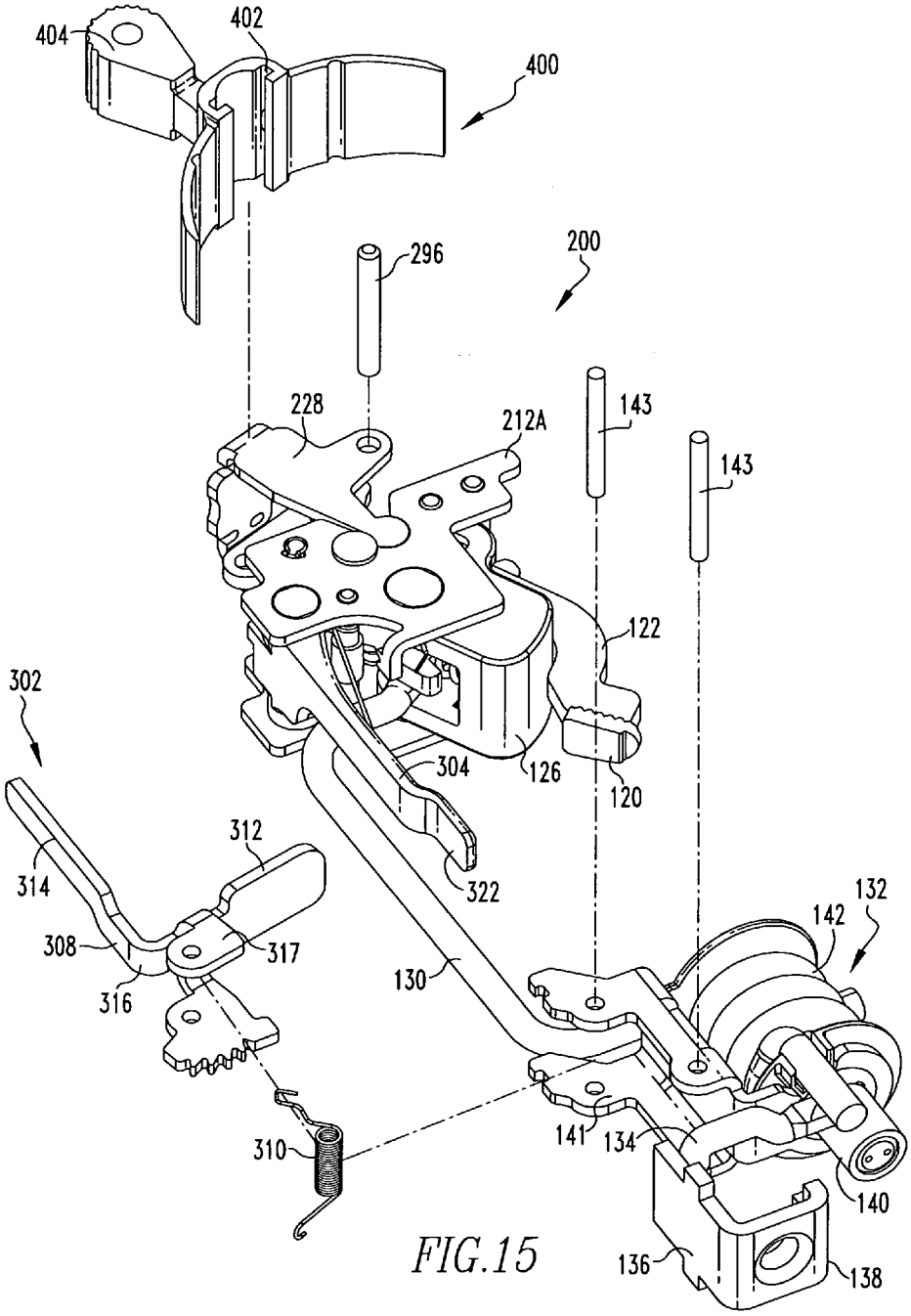
FIG. 15 is a partially exploded view of the trip device and handle assembly of the circuit breaker of FIG. 1.

As shown in FIGS. 13 and 14, the trip device 300 is disposed in the housing assembly 20 and structured to selectively engage the operating mechanism 200 so that, during normal operation the movement of the operating mechanism 200 is arrested and during an over-current condition, the operating mechanism 200 moves the contacts 110, 120 from the first position to the second position. The trip device 300 includes an armature assembly 302, a trip bar 304, an intermediate latch 306 and one or more springs 390. As shown in FIG. 15, the armature assembly 302 includes an armature 308 and an armature return spring 310. The armature 308 is acted upon by the magnetic force created by the coil assembly 132. In the embodiment shown, the axis of the coil assembly 132 extends in a direction generally parallel to the longitudinal axis of the housing assembly 20 and the armature 308 is an elongated, bent member. That is, the armature 308 has a first portion 312 and a second portion 314 wherein the first and second portions 312, 314 are joined at a vertex 316 at an angle of about ninety degrees. A tab 317 with a pivot opening adjacent to the armature vertex 316 is structured to be pivotally coupled to the coil assembly frame 141. The armature first portion 312 is made from a magnetically affective material, that is, a material that is affected by magnetic fields, such as steel. The armature first portion 312 extends from the armature vertex 316 to a location adjacent to the coil assembly spool 140. The armature second portion 314 extends toward the trip bar 304.

Figure 16:
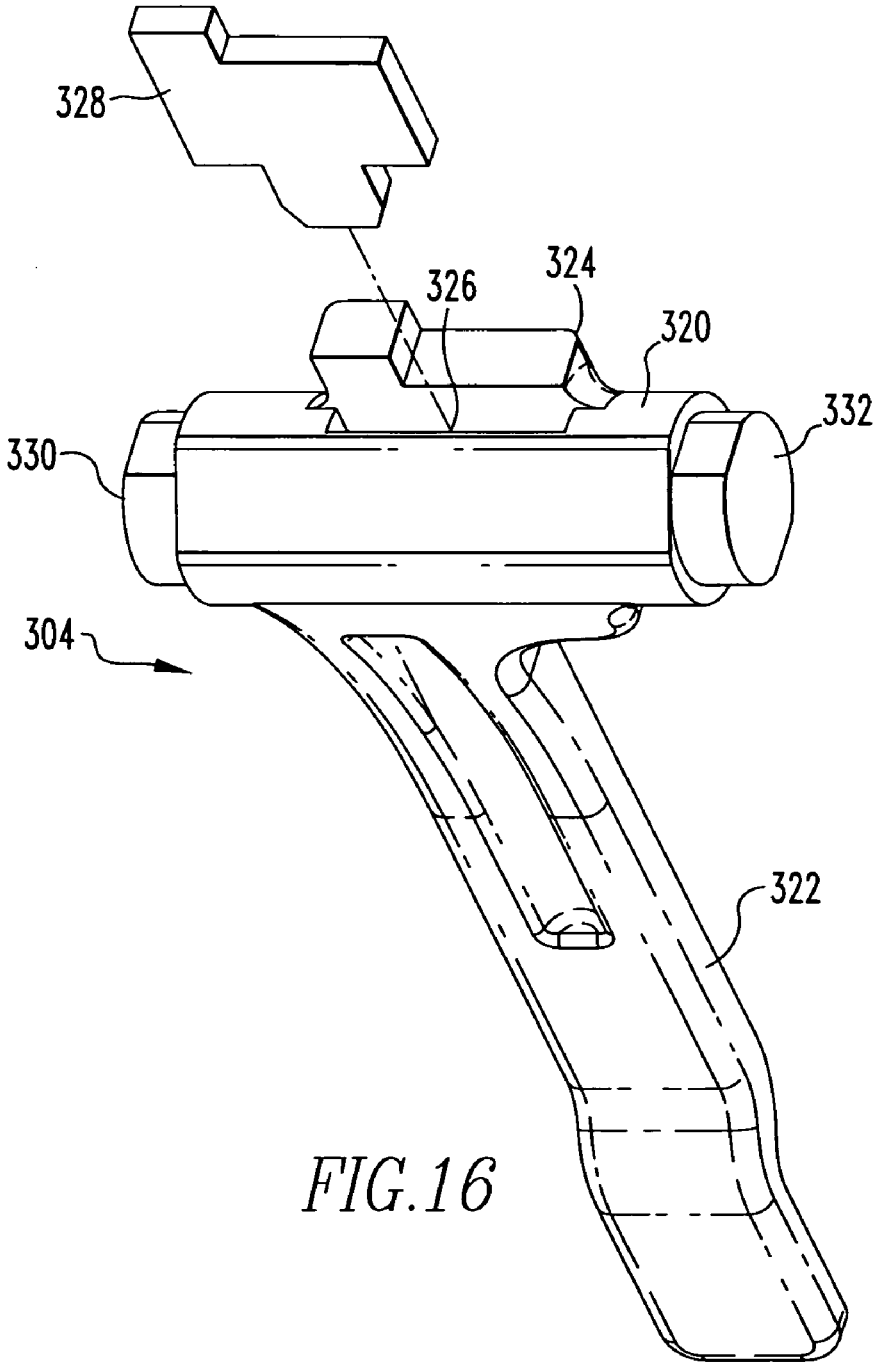
FIG. 16 is an exploded view of the trip bar of FIG. 13.

As shown in FIG. 16, the trip bar 304 includes a generally cylindrical body 320, an actuator arm 322 extending generally radially from the trip bar body 320, and a latch extension 324 extending generally radially from the trip bar body 320. In the embodiment shown in the Figures, the actuator arm 322 and the latch extension 324 extend in generally opposite directions. The trip bar body 320 also includes two axial hubs 330, 332. The hubs 330, 332 are generally cylindrical and, preferably, have a diameter that is smaller than the diameter of the trip bar body 320. The hubs 330, 332 are structured to be rotatably disposed in opposed trip bar openings 243A, 243B (FIG. 11) on the operating mechanism side plates 212A, 212B. The latch extension 324 also includes a pocket 326 and a latch plate 328. The latch plate 328 is disposed partially in the pocket 326 and has an external portion having the same general shape as the latch extension 324. The latch plate 328 is, preferably, made from a durable metal.

Figure 17:
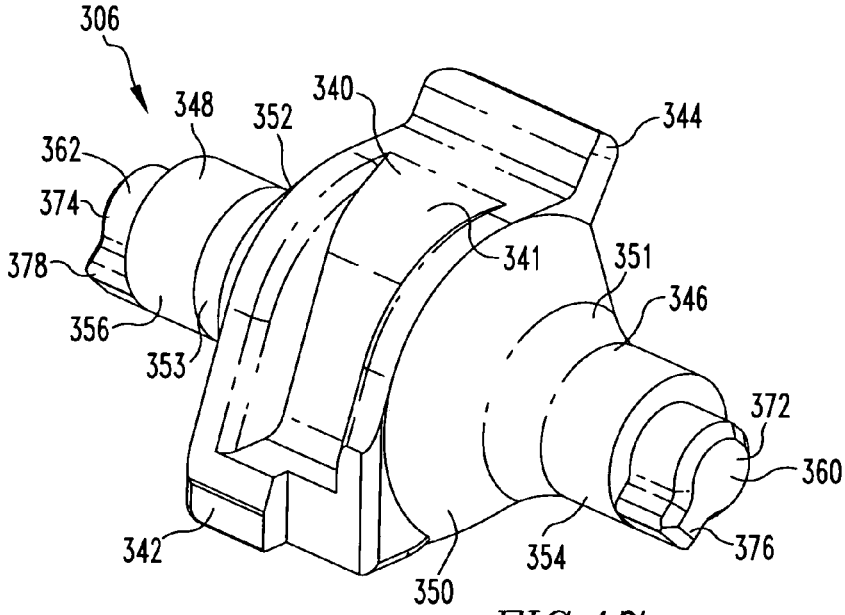
FIG. 17 is an isometric top view of the intermediate latch of FIG. 10.
Figure 18:
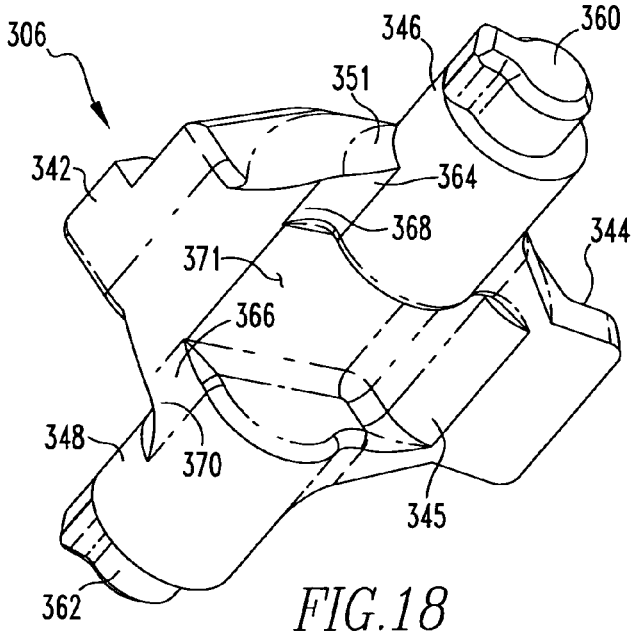
FIG. 18 is an isometric bottom view of the intermediate latch of FIG. 10.

As shown in FIGS. 17 and 18, the intermediate latch 306 includes a body 340, which is preferably made from die cast metal, having a central portion 341 with an extending trip bar latch member 342, a cradle guide 344 and at least one, and preferably two, two axle members 346, 348. The axle members 346, 348 extend in generally opposite directions from the body central portion 341. Each axle member 346, 348 includes a partial hub 350, 352, a cylindrical member 354, 356 and a keyed hub 360, 362. Each partial hub 350, 352 is a tapered arcuate member having a thicker, axial base portion 364, 366 adjacent to the cylindrical member 354, 356 which tapers radially to a thinner, edge portion 368, 370. That is, the cylindrical members 354, 356 extend from the associated partial hub base portion 364, 366. Preferably, the partial hub axial base portion 364, 366 has a thickness of between about 0.045 and 0.075 inch and, more preferably, about 0.060 inch. The partial hub edge portion 368, 370 has a thickness of between about 0.025 and 0.065 inch and, more preferably, about 0.032 inch on a first end, which is disposed adjacent to the cradle 220, and about 0.060 inch on a second end, which is disposed adjacent to the trip bar 304. Between each cylindrical member 354, 356 and the associated partial hub 350, 352 is a transition portion 351, 353. The transition portions 351, 353 are arcuate members extending, generally, over the same arc as the partial hubs 350, 352 and extend at an angle between the cylindrical member 354, 356 and the associated partial hub 350, 352. In this configuration, the transition portions 351, 353 act to reinforce the joint between the cylindrical member 354, 356 and the associated partial hub 350, 352. The cylindrical members 354, 356 have a diameter that is smaller than the partial hubs 350, 352 and extend in opposite directions, generally from the axis of the partial hubs 350, 352. Thus, the cylindrical members 354, 356 are disposed in a spaced relation and separated by the central portion 341. Further, the cylindrical members 354, 356 form a bifurcated axle for the intermediate latch 306. In between the cylindrical members 354, 356 is a cradle passage 371 sized to allow the cradle 220 to pass therethrough.

The distal end of each cylindrical member 354, 356 terminates in the keyed hub 360, 362. Each keyed hub 360, 362 includes a generally circular portion 372, 374 and a radial extension 376, 378. The keyed hub 360, 362 is structured to be disposed in a keyed opening 241A, 241B (FIG. 11) on the operating mechanism side plates 212A, 212B. The trip bar latch member 342 extends outwardly from the latch body 340 and beyond the partial hubs 350, 352. The trip bar latch member 342 is structured to engage the trip bar 304 (FIG. 13). The cradle guide 344 has an inner edge, adjacent to the cradle passage 371, structured to engage the operating mechanism 200 and is hereinafter identified as the operating mechanism latch 345.

The trip device 300 is assembled as follows. The armature vertex tab 317 (FIG. 15) is pivotally coupled to the coil assembly frame 141. As shown in FIGS. 13 and 14, the armature first portion 312 extends from the armature vertex 316 to a location adjacent to the coil assembly spool 140. The armature second portion 314 extends toward the trip bar 304. The armature return spring 310 is structured to bias the armature first portion 312 away from the coil assembly 132. In this configuration, the armature 308 may pivot over a partial arc indicated by the arrow 309 in FIG. 13. That is, when an over-current condition occurs, the magnetic field generated by the coil assembly 132 overcomes the bias of the armature return spring 310 and the armature 308 pivots with the armature first portion 312 moving toward the coil assembly 132 and the armature second portion 314 moving toward the trip bar actuator arm 322 as described below.

The trip bar 304 is rotatably coupled to the cage 210 with hubs 330, 332 disposed in opposed trip bar openings 243A, 243B. The actuator arm 322 extends away from the handle member 404 towards the armature second portion 314 and into the path of travel thereof. In this configuration, the trip bar 304 is structured to be rotated when engaged by the armature second portion 314. A trip bar spring 391 biases the trip bar 304 to a first, on position. When acted upon by the armature 308, the trip bar 304 rotates to a second, trip position (FIG. 6). Thus, the trip bar 304 is structured to move between two positions: a first generally horizontal position, wherein the latch extension 324 extends generally horizontal, and a second position, wherein, the actuator arm 322 having been engaged by the armature second portion 314, the actuator arm 322 and the latch extension 324 are rotated counter-clockwise, as shown in FIG. 6. That is, the latch extension 324 is rotated away from the operating mechanism 200.

The intermediate latch 306 is coupled to the cage 210 with a keyed hub 360, 362 rotatably disposed in a keyed opening 241A, 241B on each side plate 212A, 212B. As the intermediate latch 306 is rotated, the trip bar latch member 342 has an arcuate path of travel. The intermediate latch 306 is disposed just above the trip bar 304 so that the path of travel of the trip bar latch member 342 extends over the latch extension 324 and with the cradle passage 371 aligned with the cradle 220. In this configuration, when the operating mechanism 200 is in the on position, the cradle 220 is disposed within the cradle passage 371 with the cradle latch edge 278 engaging the operating mechanism latch 345. As noted above, the primary spring 232 biases the cradle 220 toward the handle member 404. Thus, the bias of the cradle 220 biases the intermediate latch 306 to rotate counter-clockwise as shown in FIG. 5; however, when the trip bar 304 is in the normal operating position, the latch extension 324, and more preferably the latch plate 328, engages the trip bar latch member 342 thereby preventing the intermediate latch 306 from rotating. This configuration is the normal operating configuration when the circuit breaker 10 and the operating mechanism 200 are in the on position and the separable contacts 105 are closed.

Figure 7:
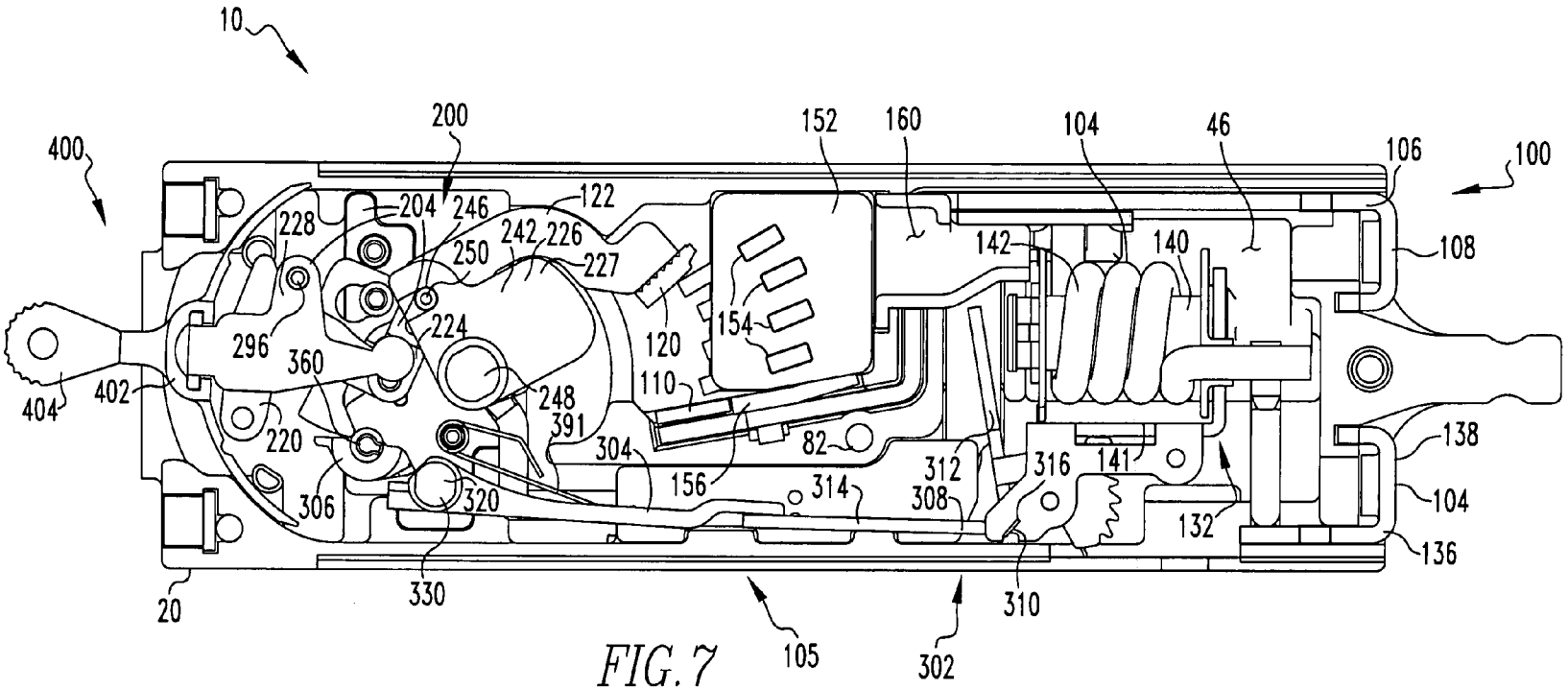
FIG. 7 is a side view of the circuit breaker of FIG. 1 with a housing half shell removed, the operating mechanism cage side plate removed, and showing the circuit breaker in the tripped position.
Figure 8:
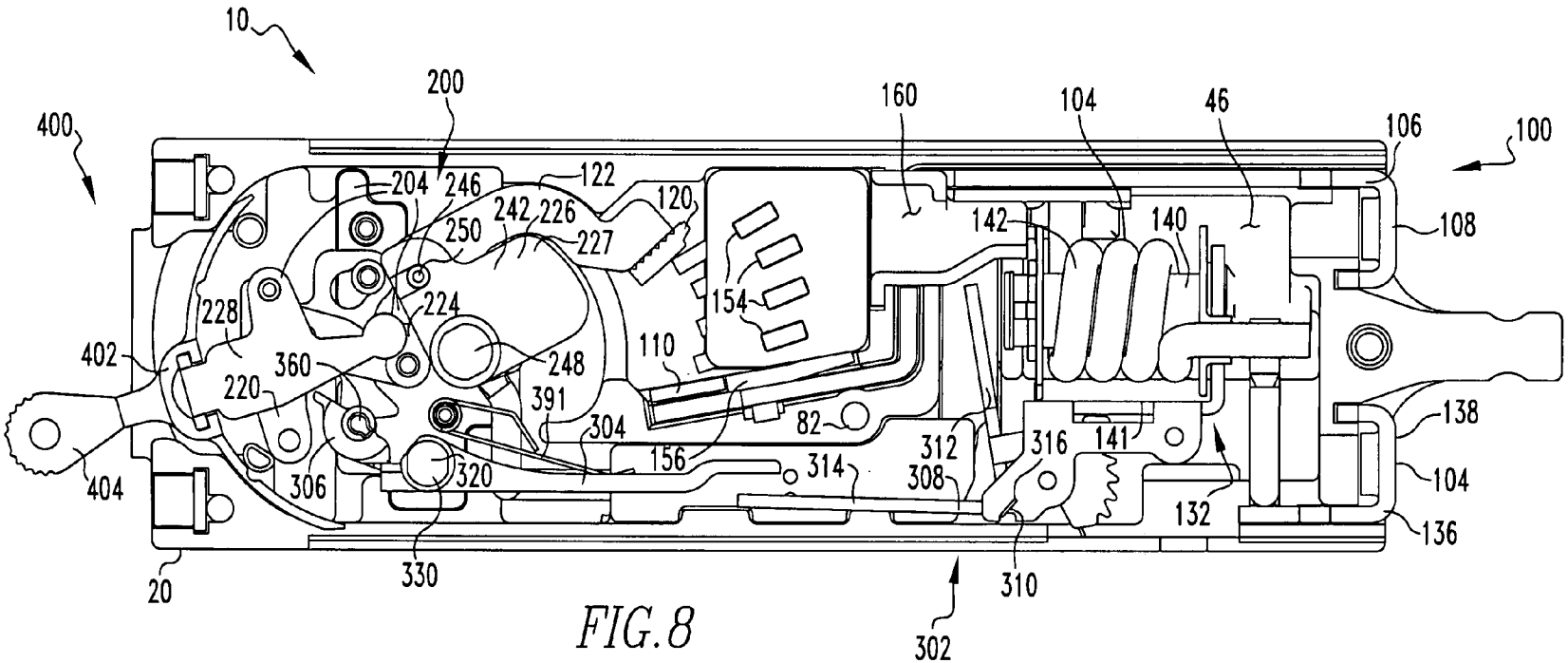
FIG. 8 is a side view of the circuit breaker of FIG. 1 with a housing half shell removed, the operating mechanism cage side plate removed, and showing the circuit breaker in the off position.
Figure 9:
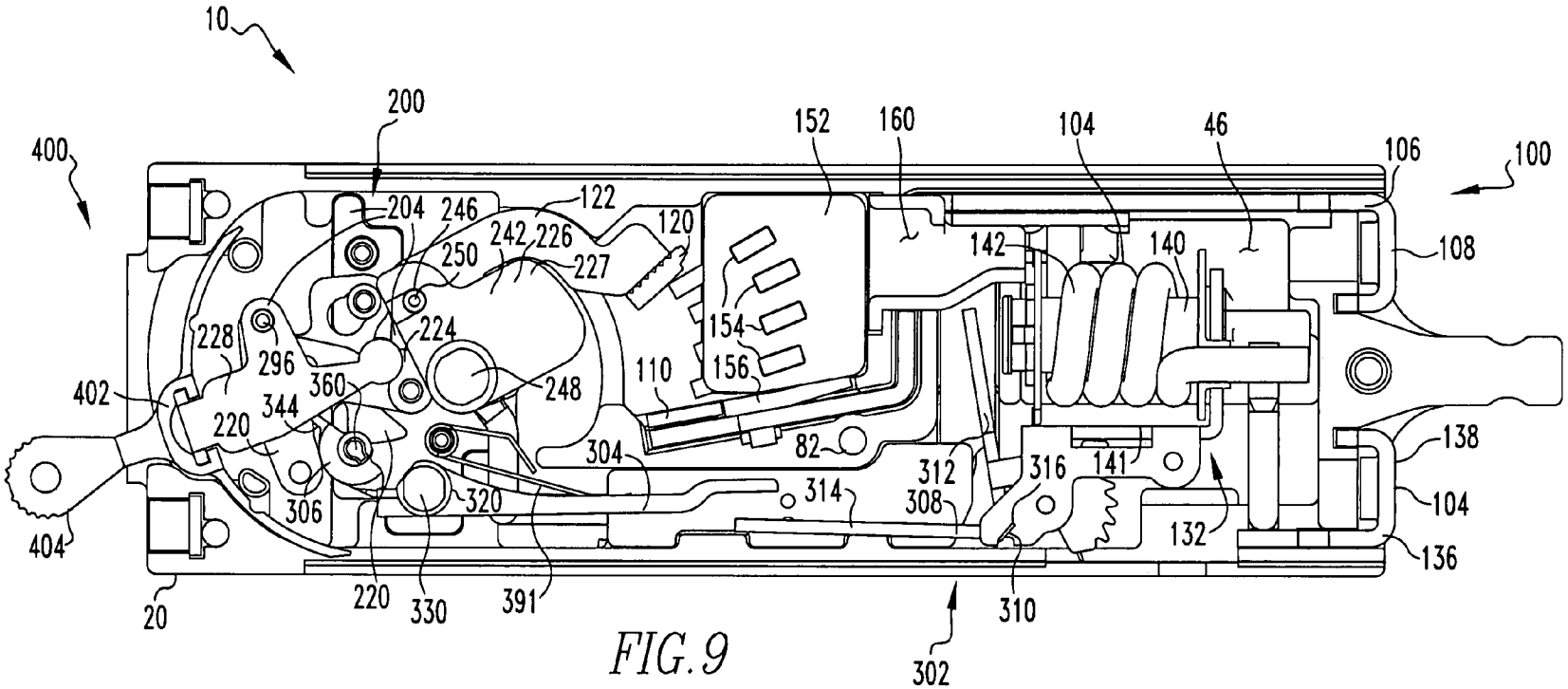
FIG. 9 is a side view of the circuit breaker of FIG. 1 with a housing half shell removed, the operating mechanism cage side plate removed, and showing the circuit breaker in the reset position.
Figure 10:
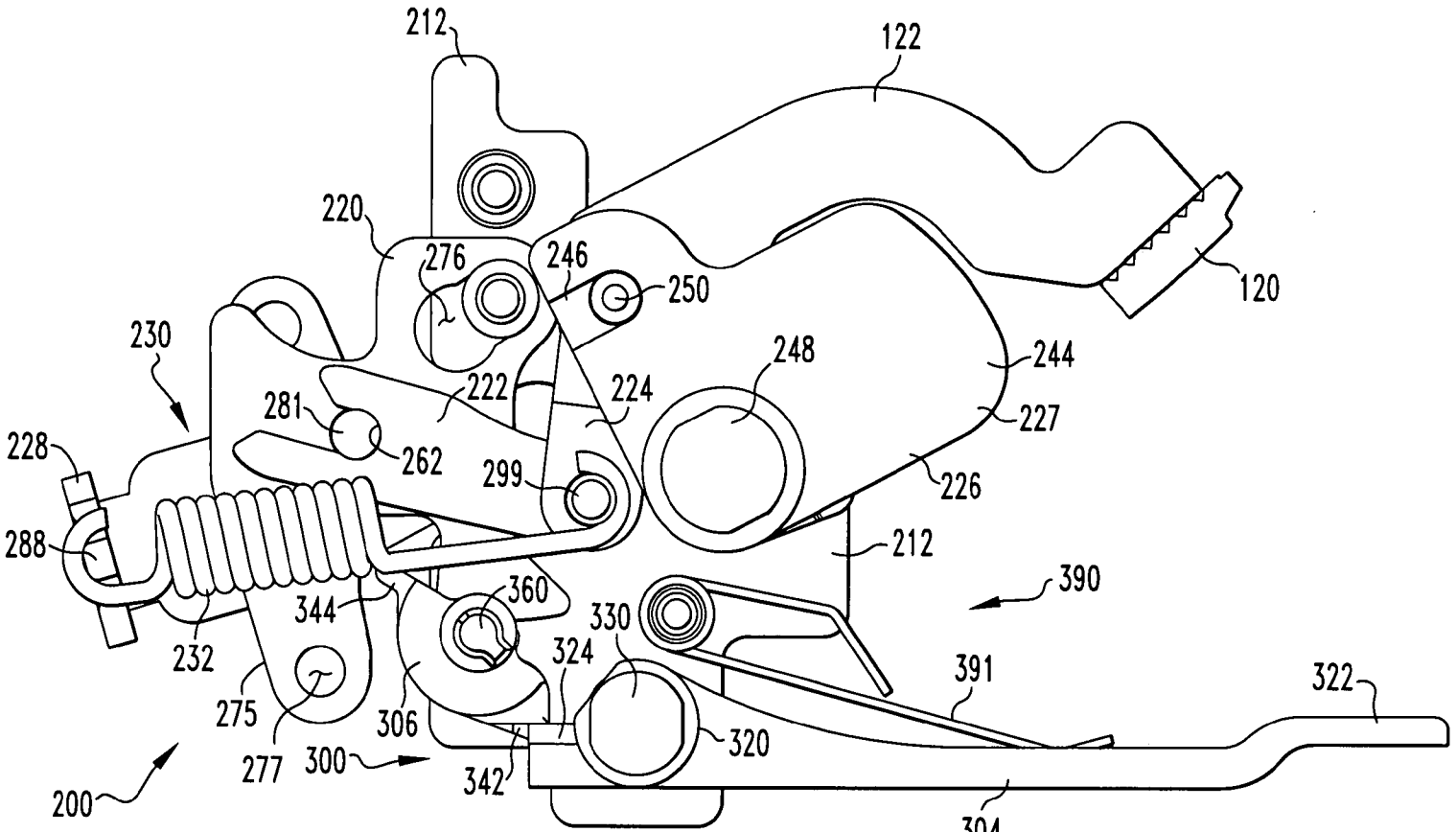
FIG. 10 is a detail side view of the operating mechanism for the circuit breaker of FIG. 1 in the off position.

When an over-current condition occurs, the coil assembly 132 creates a magnetic field sufficient to overcome the bias of the armature return spring 310. As shown in FIG. 6, when the bias of the armature return spring 310 is overcome, the armature 308 rotates in a clockwise direction so that the armature second portion 314 engages and moves the actuator arm 322. Movement of the actuator arm 322 causes the trip bar 304 to rotate in a counter-clockwise direction until the latch extension 324 (FIG. 16) disengages the trip bar latch member 342 (FIG. 17). Once the trip bar latch member 342 is released, the intermediate latch 306 is free to rotate. Thus, the bias of the primary spring 232 causes the cradle 220 to move toward the handle member 404 and disengage the operating mechanism latch 345 (FIG. 18). At this point, and as shown in FIG. 7, the operating mechanism 200 moves into the trip position as described above, thereby separating the contacts 110, 120 as a result of the over-current condition. As also noted above, when the operating mechanism 200 is moved into the reset position, shown in FIG. 9, the cradle 220 re-engages the trip device 300. More specifically, when the operating mechanism 200 is moved into the reset position, the cradle 220 is moved away from the handle member 404 into the cradle passage 371 until the cradle latch edge 278 is to the right, as shown in FIG. 9, of the operating mechanism latch 345 (FIG. 18). As shown in FIGS. 7 and 9, as the cradle 220 is moved away from the handle member 404, the cradle latch edge 278 engages the cradle guide 344 (FIG. 17) on the intermediate latch 306 and causes the intermediate latch 306 latch to rotate in a clockwise direction, as shown in FIG. 9. The motion on the intermediate latch 306 returns the trip bar latch member 342 to a generally horizontal position. The trip bar 304 may be momentarily displaced as the trip bar latch member 342 moves past the trip bar, then the trip bar spring 391 returns the trip bar 304 to the trip bar first position. Thus, the trip bar latch extension 324 is repositioned to the right, as shown in FIG. 9, of the trip bar latch member 342. As pressure on the handle assembly 400 is released and the operating mechanism 200 returns to the on position, the primary spring 232 biases the cradle 220 toward the handle member 404 so that the cradle latch edge 278 reengages the operating mechanism latch 345 (FIG. 18). Thus, as set forth above, the bias of the cradle 220 biases the intermediate latch 306 to rotate counter-clockwise so that the trip bar latch member 342 contacts the trip bar latch extension 324, and more preferably the latch plate 328. When the trip bar 304 is reengaged by the intermediate latch 306 and movement of the operating mechanism 200 is arrested, the circuit breaker 10 is again in the on position.

As shown in FIG. 15, the handle assembly 400 includes a base member 402 and a handle member 404. The handle assembly base member 402 is coupled to the handle arm 228 of the operating mechanism 200. When the circuit breaker 10 is fully assembled, the handle member 404 extends through the handle member opening 52 (FIG. 1). Accordingly, a user may manipulate the position of the operating mechanism 200 by moving the handle member 404. The housing assembly 20 may include indicia that indicate that a certain handle member 404 position corresponds to a certain operating mechanism 200 position. Moreover, the handle assembly base member 402 may include a color indicia, typically a bright red, at a selected location that is within the housing assembly 20 when the operating mechanism 200 is in the on position, but is visible through the handle member opening 52 when the operating mechanism 200 is in the tripped, off, or reset positions. Thus, a user may visually determine if the circuit breaker 10 is closed or open.

Additionally, as shown in FIG. 2, the circuit breaker 10 may include a suitable non-contact sensor 415 (shown in phantom). The non-contact sensor 415 is structured to be employed as part of an auxiliary switch (not shown).

Figure 19:
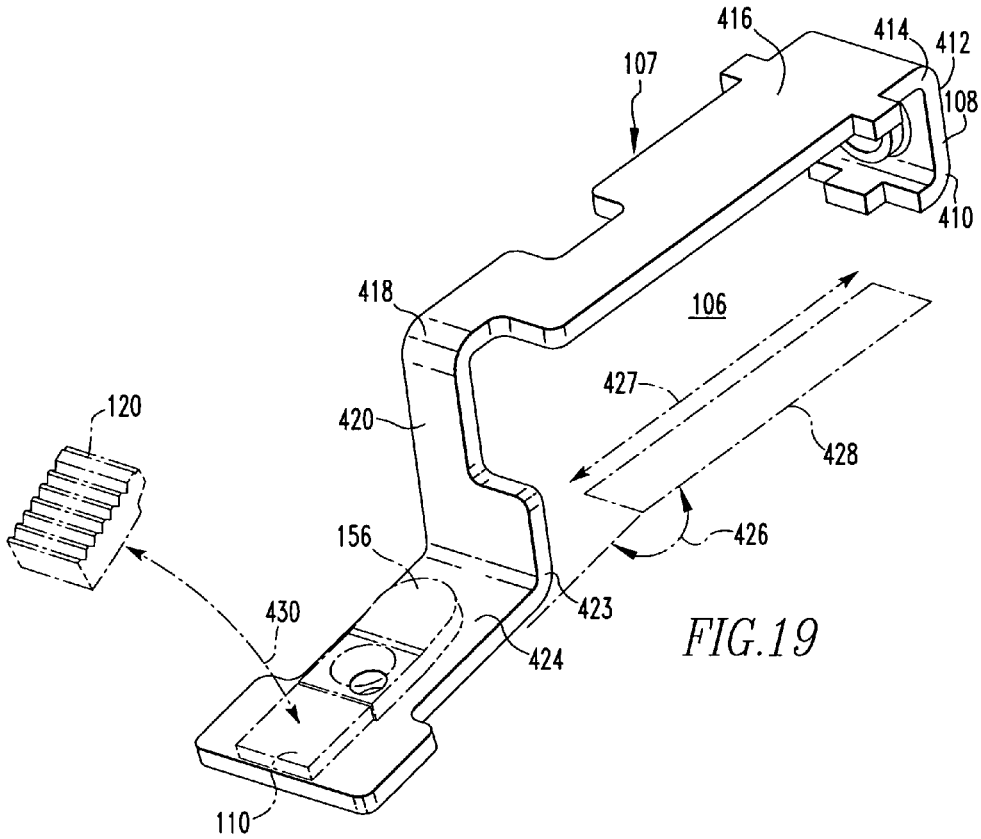
FIG. 19 is an isometric view of the line conductor of FIG. 3.

Referring to FIG. 19, the line conductor 106 is shown. The line conductor 106 is electrically disposed between the line end 108 and the fixed contact 110 (shown in phantom line drawing in FIG. 19). The line conductor 106 includes a first 90° bend 410, a first longitudinal segment (e.g., portion) 412, a second 90° bend 414, a second longitudinal portion 416, a third 90° bend 418, a third longitudinal portion 420, an example fourth −100° bend 423, and a fourth longitudinal portion 424, which carries the fixed contact 110 (e.g., without limitation, welded thereto) and the arc runner 156 (shown in phantom line drawing in FIG. 19) (e.g., without limitation, riveted thereto). For consistency of disclosure, the angles of the bends 410,414,418,423 are measured counterclockwise with respect to FIG. 19. It will be appreciated that such angles may alternatively be measured clockwise and/or with respect to another frame of reference. The fourth −100° bend 423 (as best shown in FIG. 3) establishes a line conductor angle 426 of 170° (e.g., 3*90°−100°=170°) with respect to a general longitudinal axis 427 or to a plane 428 which is parallel to the surface of the housing side 40 (FIG. 1). This bend 423 is structured to increase a gap 430 (shown in phantom line drawing) between the separable contacts 110,120 in the open position (FIG. 3).

As shown with reference to FIGS. 3 and 19, the fourth longitudinal portion 424 (FIG. 19) carries one or both of the fixed contact 110 and the arc runner 156. The arc chute, such as the arc extinguisher assembly 150, is carried by the housing assembly 20 (e.g., without limitation, held in pockets (not shown) thereof) proximate the arc runner 156 and the fourth longitudinal portion 424 (FIG. 19).

EXAMPLE 1

For the example circuit breaker 10, if the angle 426 of the line conductor 106 would be 180° (not shown), then the contact gap 430 (e.g., opening angle of the moving arm 122 (FIG. 3)) would be about 22.5°. For example, by changing the line conductor angle 426 to 170°, the opening angle 430 is, thus, increased to about 32.5°, as shown. This opening angle 430 is the optimum angle for the example circuit breaker 10 and is dictated mainly, in this example, by the height (H) (FIG. 1) of the circuit breaker housing assembly 20.

EXAMPLE 2

Alternatively, for the example circuit breaker 10, a line conductor angle 426 between about 170° and less than 180° degrees may be used, although this angle would not be optimal for the example circuit breaker.

EXAMPLE 3

The arc chute 150 (FIG. 3) is preferably employed. The thickness of the arc plates 154, the size of the arc plates 154, and the spacing between the arc plates 154 may be increased when the contact gap (e.g., opening angle) 430 is increased. This increase in the size of the arc chute 150 and the arc plates 154 further protects the separable contacts 110,120 by reducing the arcing on such contacts and by moving the arc further into the arc chute 150.

EXAMPLE 4

It will be appreciated that the angle 426 is substantially greater than 90 degrees and is less than 180 degrees.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a line end;

a load end;

a pair of separable contacts electrically disposed between said line end and said load end, said separable contacts including an open position and a closed position;

an operating mechanism comprising a movable arm carrying one of said separable contacts, said movable arm comprising an elongated body having a first general longitudinal axis and an offset disposed at one end, said offset structured to displace said one of said separable contacts relative to the first general longitudinal axis of said elongated body, said operating mechanism structured to move said separable contacts between the open position and the closed position;

a line conductor carrying the other one of said separable contacts, said line conductor electrically connected between said line end and said other one of said separable contacts, said line conductor including a second general longitudinal axis and a bend portion structured to increase a gap between said separable contacts in said open position, said bend portion in said open position forming an angle which is substantially greater than 90 degrees and less than 180 degrees between said other one of said separable contacts and said second general longitudinal axis, said first general longitudinal axis being generally parallel to said second general longitudinal axis in said closed position;

an arc chute disposed proximate said separable contacts; and wherein said line conductor is an elongated line conductor having a first elongated portion parallel to said second general longitudinal axis and a second portion carrying said other one of said separable contacts; and wherein said angle is between said second portion and said second general longitudinal axis.

2. A circuit breaker comprising:

a housing;

a line end;

a load end;

a pair of separable contacts electrically disposed between said line end and said load end, said separable contacts including an open position and a closed position;

an operating mechanism comprising a movable arm carrying one of said separable contacts, said movable arm comprising an elongated body having a first general longitudinal axis and an offset disposed at one end, said offset structured to displace said one of said separable contacts relative to the first general longitudinal axis of said elongated body, said operating mechanism structured to move said separable contacts between the open position and the closed position;

a line conductor carrying the other one of said separable contacts, said line conductor electrically connected between said line end and said other one of said separable contacts, said line conductor including a second general longitudinal axis and a bend portion structured to increase a gap between said separable contacts in said open position, said bend portion in said open position forming an angle which is substantially greater than 90 degrees and less than 180 degrees between said other one of said separable contacts and said second general longitudinal axis, said first general longitudinal axis being generally parallel to said second general longitudinal axis in said closed position;

an arc chute disposed proximate said separable contacts;

wherein said line conductor is in a fixed position within said housing;

wherein said other one of said separable contacts is in a fixed position within said housing; and wherein said housing is an elongated housing having an elongated side parallel to said second general longitudinal axis; wherein said line conductor has a first elongated portion and a second portion carrying said other one of said separable contacts, said first elongated portion being parallel to both of said second general longitudinal axis and said elongated side; and wherein said angle is between said second portion and said second general longitudinal axis.

3. The circuit breaker of claim 2 wherein said offset is a bend of said elongated body, said bend of said elongated body is structured to displace said one of said separable contacts away from the first general longitudinal axis of said elongated body and toward said other one of said separable contacts in the closed position.

* * * * *